US006099768A

United States Patent [19]

Strickland et al.

[11] Patent Number: 6,099,768

[45] Date of Patent: Aug. 8, 2000

[54] MODULAR BUILDING PANEL AND METHOD FOR CONSTRUCTING THE SAME

[75] Inventors: Michael R. Strickland, Richmond Hill, Canada; Charles A. J. Theodore, Wayland, Mass.

[73] Assignee: Canam Manac Group, Inc., Quebec, Canada

[21] Appl. No.: 09/295,911

[22] Filed: Apr. 21, 1999

Related U.S. Application Data

[62] Division of application No. 09/084,047, May 22, 1998.

[51] Int. Cl.[7] ..... E04B 1/78

[52] U.S. Cl. ..... 264/46.4; 52/309.11; 52/309.7; 264/46.4; 264/46.7; 264/511

[58] Field of Search ..... 29/897.32; 52/745.19, 52/742.13, 309.11, 309.7, 309.9; 264/46.4, 46.7, 46.5, 511

[56] References Cited

U.S. PATENT DOCUMENTS

| | | | |
|---|---|---|---|
| 3,077,426 | 2/1963 | Johnston | 52/478 |
| 3,405,493 | 10/1968 | Omholt | 52/742.13 X |
| 3,785,913 | 1/1974 | Hallamore | 161/41 |
| 3,965,635 | 6/1976 | Renkert | 52/434 |
| 4,068,434 | 1/1978 | Day et al. | 52/220 |
| 4,253,288 | 3/1981 | Chun | 52/454 |
| 4,558,552 | 12/1985 | Reitter, II | 52/745.19 |
| 4,914,883 | 4/1990 | Wencley | 52/745.19 |
| 5,055,252 | 10/1991 | Zimmerman | 264/263 |
| 5,129,628 | 7/1992 | Vesper | 256/31 |
| 5,269,109 | 12/1993 | Gulur | 52/309.9 |
| 5,497,589 | 3/1996 | Porter | 52/309.7 |
| 5,524,412 | 6/1996 | Corl | 52/745.19 |
| 5,548,937 | 8/1996 | Shimonohara | 52/742.13 X |
| 5,561,960 | 10/1996 | Minnick | 52/578 |
| 5,638,651 | 6/1997 | Ford | 52/309.7 X |
| 5,655,350 | 8/1997 | Patton | 52/742.13 |
| 5,743,056 | 4/1998 | Balla-Goddard et al. | 52/309.11 |
| 5,758,463 | 6/1998 | Mancini, Jr. | 52/309.12 |
| 5,758,464 | 6/1998 | Hatton | 52/404.1 |

*Primary Examiner*—Carl D. Friedman
*Assistant Examiner*—Phi Dieu Tran A
*Attorney, Agent, or Firm*—Cesari and McKenna, LLP; William A. Loginov

[57] ABSTRACT

A modular building panel and a method for constructing the same provides a framework composed of structural members, typically formed of metal, and a backer board typically formed of a cementacious composite for receiving an exterior wall coating surface. The backer board and the framework are separated from, and insulated from, each other by a layer of foam that is applied in liquid form and that expands and cures into a solid form. Substantially no fasteners extend between the backer board and the metal framework to reduce conduction of heat therebetween. The foam serves as an adhesive to hold the backer board rigidly in place at a predetermined spacing from the framework and to anchor the backer board to the structural members. The structural members can comprise U-shaped and C-shaped channel beams for further rigidity and enhanced anchoring. Upon assembly, the backer board and the framework are overlaid upon each other, typically using spacers of a predetermined spacing thickness. Spacers can be formed from pieces of foam having adhesive or double-sided tape to maintain them in alignment with the framework and backer board. Liquid foam is applied from the interior side of the framework and expands toward the interior side of the framework.

5 Claims, 7 Drawing Sheets

MODULAR BUILDING PANEL AND METHOD FOR CONSTRUCTING THE SAME

RELATED APPLICATION

This is a Division of co-pending U.S. patent application Ser. No. 09/084,047, filed on May 22, 1998.

FIELD OF THE INVENTION

This invention relates to modular buildings, and more particularly to techniques for securing insulation and exterior wall surfaces to modular buildings.

BACKGROUND OF THE INVENTION

It is increasingly desirable, particularly in the field of commercial building construction, to provide wall panels in the form of modular members. These wall panels are typically rectangular in outline. The panels have structural vertical members at each end that are generally joined by bolts or other fasteners to adjoining vertical members. In addition, several horizontal members can be used to join the main structural vertical members, and to form the floor plate and ceiling member for the panel. In one example, the panels are approximately 10 feet tall (vertically) and up to 20 feet or more in length (horizontally). Heights exceeding 50 feet have been constructed. A system for joining modular panels is taught in co-pending U.S. patent application Ser. No. 09/046,758 filed Mar. 24, 1998. This application describes, generally, the joining of panels using shims between adjoining structural vertical members to provide expansion joints between panels. This application is expressly incorporated herein by reference. The panels described in this co-pending application, and herein, can include those produced by Canam Manac of Canada under the trademark MUROX™.

It is increasingly desirable to construct as much of a wall panel as possible before it is assembled and placed at a building site. Insulation, exterior skin, interior skins and even utilities can be effectively provided two panels before they are assembled. Appropriate access holes are generally provided in each panel to enable the insertion and securing of bolts and for other finish work.

In the past, insulation has been provided to panels in the form of foam or fiber board laid directly over the vertical and horizontal members of the panel. The foam board is secured using metal fasteners or other devices. Alternatively, insulation is simply provided between vertical and horizontal members and an outer skin is secured directly to the vertical and horizontal members. In both instances, heat is conducted from the outer skin to the metal vertical and horizontal members. This occurs either because there is no appreciable insulation between the outer skin and the members, or because the metal fasteners transmit heat between the members and the outer skin. The transmission of heat can result in the formation of a "dew point" at the junction between the skin and the panels. This is particularly problematic in cold climates since, over time, condensation can cause rusting and failure of fasteners and metal members. Accordingly, it is desirable to separate the outer skin from all structural members by a substantial amount of insulation. It is also desirable to avoid highly conductive fasteners that would transmit heat between the metal members and the outer skin. In this way, dew point is moved completely to the outer skin where it is best handled by weather-resistant materials applied thereto.

It is, therefore, an object of this invention to provide an outer skin and insulation system for modular panels that avoids problems associated with localized dew point. It is a further observation of this invention to provide a method for rapidly and effectively applying insulation between the outer skin and the structural members of a modular building panel.

SUMMARY OF THE INVENTION

This invention overcomes the disadvantages of the prior art by providing a modular building panel and the method for constructing a modular building panel that completely separate and isolate the exterior skin surface from the structural framework formed, typically, from metal frame members. A layer of foam insulation, defining a matrix with air/gas filled cells, and having substantially no fasteners within it, secures a backer board of the exterior skin and the frame members together. This layer of insulation is sufficiently thick to place the dew point toward the exterior, remote from the metal frame members, thus preventing condensation that can cause premature corrosion of the metal frame members and damage to internal wall structures.

According to a preferred embodiment the modular panel is formed from vertical structural members that can comprise U-shaped channels and transverse horizontal members joined to the structural vertical members by welds, screws, rivets or similar attachment mechanisms. A backer board composed of a cementacious composite material that is commercially available is overlaid on framework in a spaced-apart relationship. Spacers, such as pieces of foam can be used to maintain the spaced-apart relationship. The spacers can be secured to the backer board and to the frame members by appropriate adhesives or double-sided tape. From the interior side, bays formed between vertical and horizontal members are filled with a two-part Class-I liquid insulation that rapidly expands and cures into a solid foam matrix. During expansion and curing process, the foam, if skillfully applied, migrates between vertical and horizontal members and the backer board and expands into the bays toward the interior side of the framework. The foam adheres firmly to the backer board and also to the frame members to form a rigid adhesive layer between the backer board and the framework.

According to one embodiment, the backer board and framework are laid flat on a ground surface during application of foam. According to another embodiment, the backer board and the framework, along with the spacers, are maintained in a support structure so that they rest at a non-perpendicular angle. Appropriate securing mechanisms can be used to hold multiple pieces of backer board together during the foam application process. For example, spikes can be used on the support structure. Similarly, the backer board sections can include tongue-and-groove joints, or appropriate biscuit joining mechanisms can be used to secure side-by-side edges of backer board sections to each other. Adhesives can also be used to secure side-by-side edges together prior to curing of foam.

When the foam has cured, the resulting panel can have inner utilities and even exterior wall surfaces applied thereto prior to assembly at a building site. Alternatively, finish work can be accomplished at the building site. Excess foam migrating out of perimeter edges of the panel or into window or door openings within the panel can be cut away with a conventional knife edge.

BRIEF DESCRIPTION OF THE DRAWINGS

The foregoing and other objects and advantages of the invention will become more clear with reference to the following detailed description as illustrated by the drawings in which.

DETAILED DESCRIPTION OF AN ILLUSTRATIVE EMBODIMENT

Figure 1:
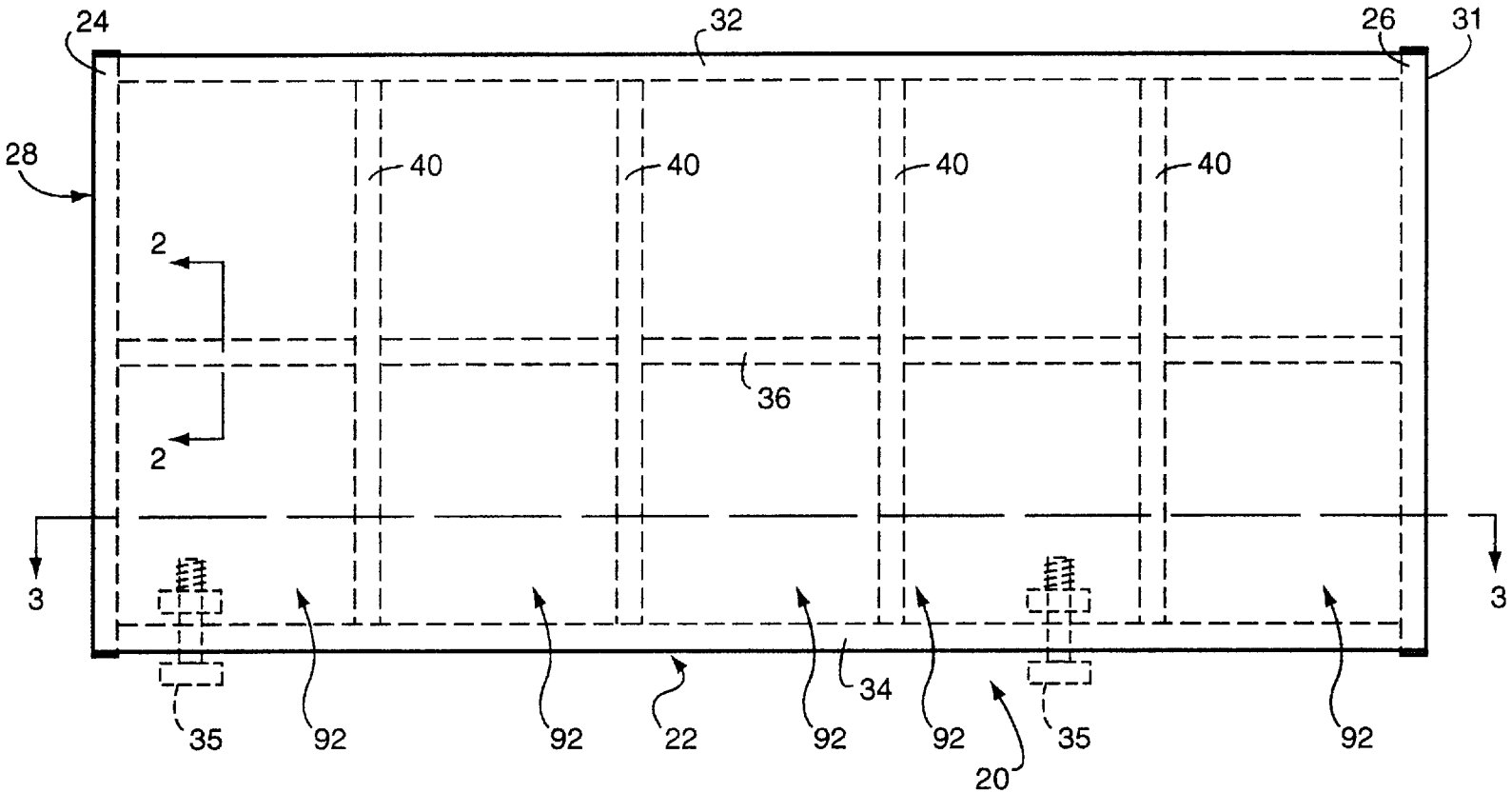
FIG. 1 is a plan view of a modular building panel according to this invention.
Figure 3:
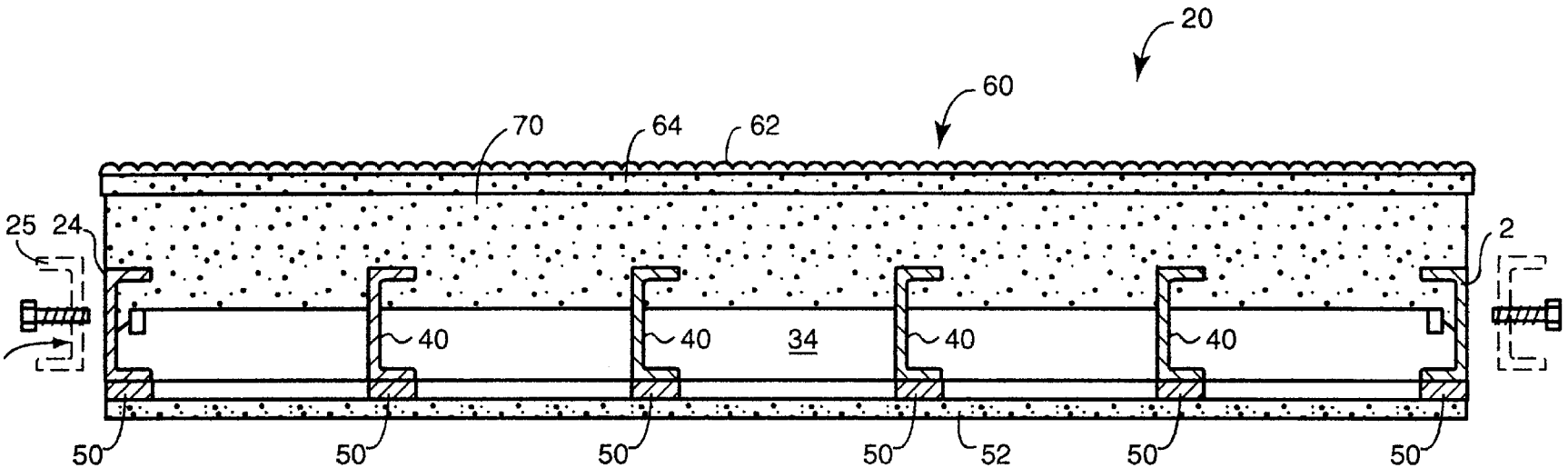
FIG. 3 is a top cross-section of the modular building panel taken along line 3—3 of FIG. 1.

FIG. 1 illustrates a modular building panel 20 in plan view. The outer perimeter 22 of the panel comprises a pair of structural vertical members 24 and 26 that define U-shaped channels. These members can be formed from structural hot-rolled steel conforming to ASTM A729 Grade 50. The sidewalls of the "U" face inwardly toward each other with the flat surface 28 and 30 of each panel facing outwardly for engagement (using bolts or other fasteners) with an identical flat surface of the vertical member of an adjoining module (See phantom members 25 and 27 in FIG. 3). An upper horizontal member 32 and a lower horizontal member 34 interconnect the two structural vertical members 24 and 26. Welds, rivets, screws or other fastening systems can be used to join the panel members together to form, in this case, a rectangular framework. While a rectangle is shown, any acceptable panel shape is contemplated. A central horizontal member 36 is also provided. Other horizontal members can be provided at various locations to define windows, doorways and other specialized structures.

Figure 2:
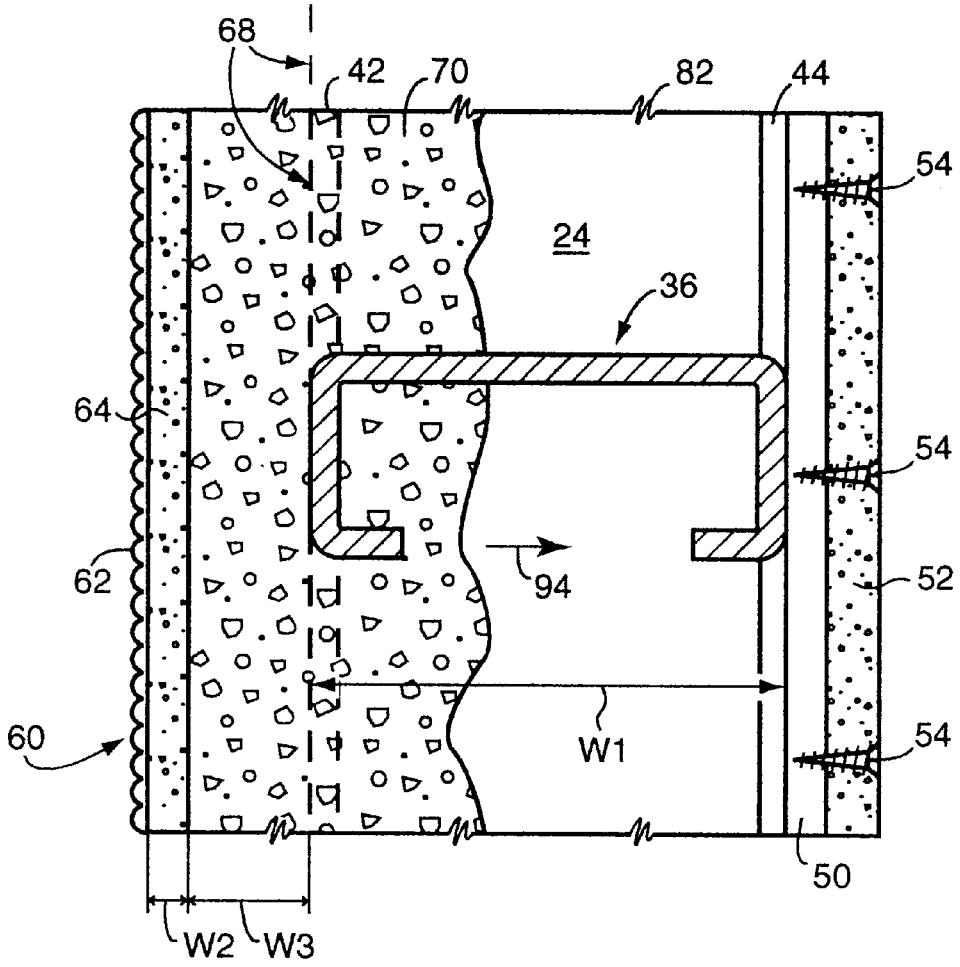
FIG. 2 is a partial side cross-section of the modular building panel taken along line 2—2 of FIG. 1.

Intermediate vertical channel members 40 extend between the upper horizontal member 32 and the lower horizontal member 34. These provide further stability to the rectangle and provide locations for fastening interior and exterior skin surfaces as described further below. FIG. 2 shows the structure of the panel in cross-section in further detail. The joint between the structural vertical member 24 and the central horizontal member 36 is shown. The inner facing sides 42 and 44 of the structural vertical member 26 are detailed. The horizontal member 36 in this embodiment is a C-shaped channel member. The width W1 of the channel members is approximately 6 inches. This, in essence, defines the structural width of the wall panel.

Joined to each structural and intermediate vertical member 24, 26 and 40 is an attachment strip or "high-hat" 50 having a thickness of approximately 1 and 1½ inch in this embodiment. Any acceptable strip can be used, or alternatively, the strip can be omitted. In one embodiment each high-hat strip is constructed from cold-rolled steel. The attachment strip enables firm attachment of a gypsum wall board 52 or other interior covering, such as a corrugated metal, to the vertical and horizontal members of the module. As will be described further below, the strip 50 and wall board 52 are often attached after the module has been placed into final position within the structure. Placement into final position typically entails securing the bottom horizontal member 34 to a slab or other foundation using bolts (shown in phantom), and attaching bolts through the vertical members 24 and 26 to secure these vertical members to the vertical members of a joining module. In this embodiment, the wall board 52 is attached to the strip 50 using drywall screws or other appropriate fasteners 54. These fasteners can also be used to secure the strip 50 to the underlying vertical members or, alternatively clips or adhesive can be used to secure the strips to their respective vertical members.

The exterior skin 60 according to this embodiment comprises a desired finish 62 that is typically weather proof. And inner backer board 64 to which the finish adheres. The exterior finish can be any acceptable finish such as wood, brick work, masonry, stucco, Exterior Insulated Finish System (EIFS) or any other relatively weather-resistant finish. The backer board, according to this embodiment comprises a composite cementacious plastercized exterior backer board commercially available from a variety of sources. This backer board is generally composed of a cement product reinforced by glass or other fibers to produce a strong, relatively lightweight surface. The thickness W2 of the backer board is between ⅝ inch and ⅜ inch according to one embodiment. As will be described further below, a relatively ⅜ inch backer board is generally preferred in this embodiment, although other thicknesses can be employed. The backer board is typically formed in sections and is joined by tongue-and-groove or other joining method to be described further below. The backer board 64 is spaced apart from the front face 68 of the vertical and horizontal members. The spacing is accomplished by a layer of foam insulation 70 according to this invention. The foam insulation 70 comprises a commercially available Class-I two-component polyurethane chemical foam system consisting of a first part of polymeric isocyanate containing reactive isocyanate groups and a second part that is a combination of polyols, catalytic and refrigerant. Foam is applied and mixed in a commercially available sprayer, and strikes the module in a liquid state that becomes rapidly expanded into a final, cured, shape. The compressor strength of the cured foam is a minimum of 10 psi. Its thermal conductivity is approximately 0.13 the flame spread value is 25 and smoke density is 280, according to generally accepted construction guidelines. These values can be varied. In addition, while the term "foam" is used in conjunction with a class one foam described above, any acceptable expanding insulating foam, that is applied in a liquid or semi-liquid state, can be substituted according to this invention.

Figure 4:
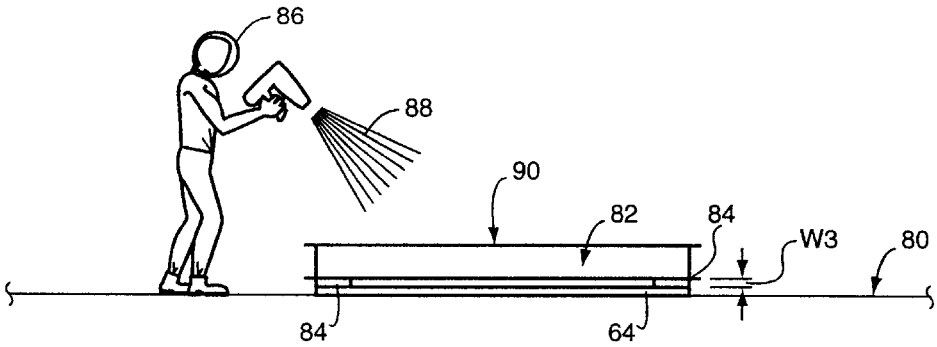
FIG. 4 is a schematic diagram illustrating the application of insulation to a panel located in a horizontal position.
Figure 5:
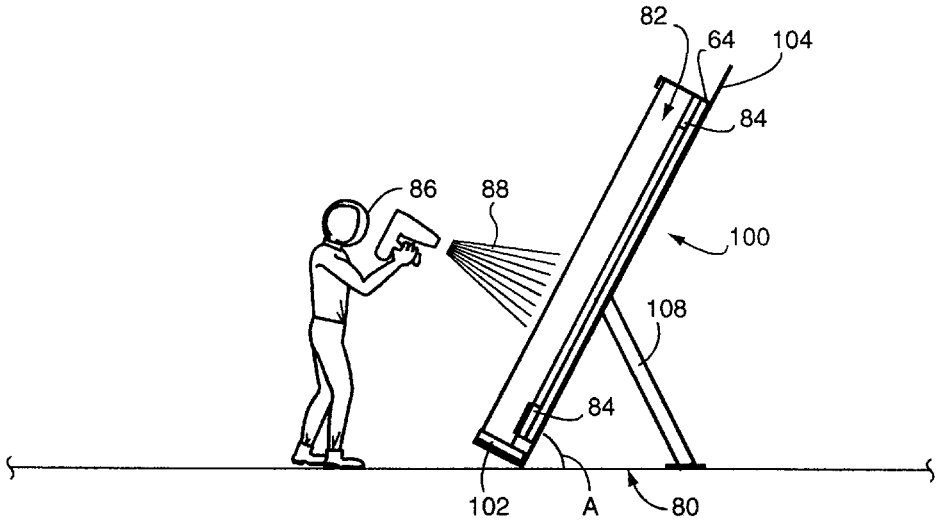
FIG. 5 is a schematic diagram illustrating the application of insulation to a panel located in an angled position.

FIGS. 4 and 5 illustrate, schematically, two different techniques for applying insulating foam to a module according to this invention. With reference first to FIG. 4, the backer board 64 is laid on a floor surface 80. The floor surface can be covered with a non-stick coating or an acceptable drop cloth. The overall framework 82 of horizontal and vertical members is spaced apart from the inner facing surface of the backer board 64 by a width W3 (see also FIG. 2). The width W3 is determined by spacers 84. The spacers can comprise any acceptable spacing structure. In this embodiment they are disposed directly between the framework 82 and the backer board 64. Alternatively, the framework can be suspended by overhanging clamps away from the backer board or any other acceptable spacing methods can be utilized. In this embodiment, the spacers 84 comprise pieces of foam insulation having the appropriate spacing thickness W3. There spacers are permanent in this embodiment, and will become welded to the cured foam as described below. The spacing thickness can be any acceptable distance necessary to move the dew point away from the framework 82. ½ inch–4 inches is a typical range of spacings. Other spacings are expressly contemplated. Once the backer board 64 has been properly aligned with the framework 82, a worker 86 or appropriate machine (not shown) directs liquid, uncured foam mixture 88 through the interior side 90 of the framework 82. The interior skin 52 and strips 50 are removed for this purpose. The foam is applied into each of the bays 92 formed between vertical members 24, 26 and 40 (see FIG. 1). The foam is applied using ordinary skill such that it migrates around the vertical members 24, 26 and 40 and the associated horizontal members 32, 34 and 36 forming a continuous matrix. The various horizontal and vertical members become partially covered by the foam as it migrates inwardly (arrow 94 in FIG. 2) back toward the sprayer. Note that the C-shaped channels used for horizontal members and, in general, for central vertical members 40, enables the foam to become firmly anchored to the C-shaped cross-section of the horizontal and interior vertical members. A sufficient amount of foam is applied to enable the foam to run completely into the space between the framework 82 and the backer board 64. In fact, excess foam preferably is allowed to run out the perimeter edges. In this embodiment, substantially the entire area of space between the backer board and plane of the outer face 68 (FIG. 2) of the framework 82 is filled. some small voids are of course possible, which is why the term "substantially" is used. This excess foam is easily removed with a knife.

As it cures, the foam also rises in the direction of the arrow 94 (FIG. 2) toward the interior, filing the interior bays 92 to a desired level. The further that the interior bays are filled the higher the insulating characteristics of the foam. It has been found that the foam has sufficient adhesive properties to firmly anchor the backer board 64 to itself and to, likewise, anchor the foam to the vertical and horizontal members of the framework. Accordingly, the foam, in essence, forms a space-filling adhesive for maintaining the backer board in firm and rigid alignment with the underlying framework. In general, no auxiliary fasteners are required between the framework and the backer board. Once the backer board is secured to the framework using the foam, and the foam is cured sufficiently, the panel can be raised and subsequently moved to its final assembly site. The backer board is permanently secured to the framework in the desired orientation at this time. Interior finish, utilities, further insulation and exterior coating can then be applied. Alternatively, any one of these steps can be performed at the panel manufacturing site for subsequent shipment to the building site.

Figure 6:
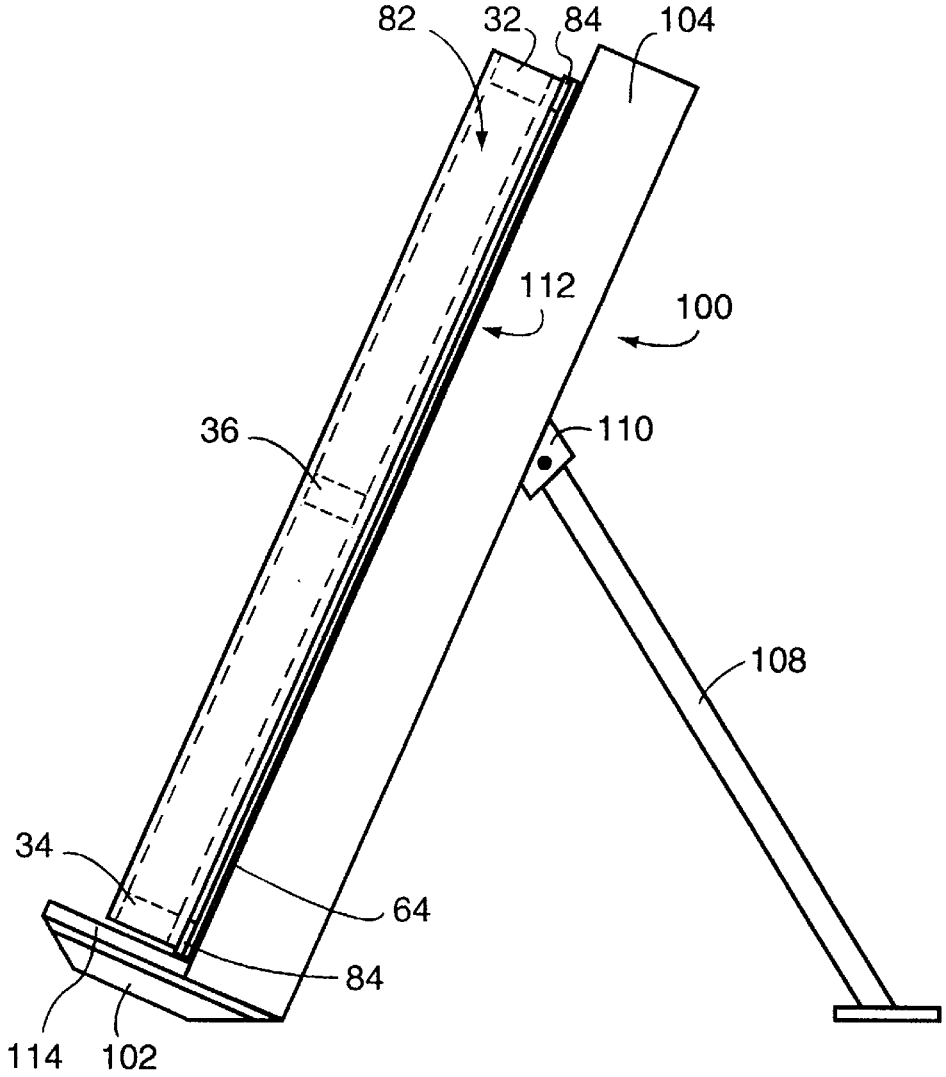
FIG. 6 is a more-detailed side view of a panel mounted on an angled support according to FIG. 5.

FIG. 5 illustrates an alternative technique for applying foam to join the backer board 64 to the framework 82. Spacers 84 are used as in the technique of FIG. 4. These spacers comprise solid foam board of an appropriate thickness. In this embodiment, in particular, the spacers 84 can be secured to the framework 82 and to the backer board 64 using an adhesive or a double-sided tape of conventional design. Such adhesive or double-sided tape can be used for spacers in any of the embodiments herein, however. The backer board 64, spacers 84 and framework 82 are positioned in a framework 100 oriented at an angle A of 45° or greater relative to a ground surface 80. The exact angle A can be any desired angle. The angle A provides ergonomics for the worker 86. The framework 100 includes a bottom stop 102 and a backing surface 104. The technique for applying foam is the same as that described with reference to FIG. 4. The foam has sufficient viscosity and adhesion so that it can be applied to the framework in a vertical, horizontal or angled state without substantial migration due to gravity. The structure 100 is shown in greater detail in FIG. 6. A support leg 108 is provided for supporting the backing surface 104 at a desired angle A. A pivot assembly 110 of any acceptable design can be used. Alternatively, a fixed support leg 108 can be provided. The supporting face 112 of the backing surface 104 can include a non-stick surface such as Teflon. This enables the module to be removed from the backing surface despite any run-out of foam. Likewise the bottom support 102 can include a non-stick surface 114 for this purpose.

Figure 7:
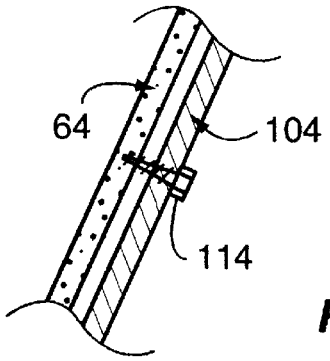
FIG. 7 is a partial cross-section of the support of FIG. 6 illustrating a panel retention spike.
Figure 8:
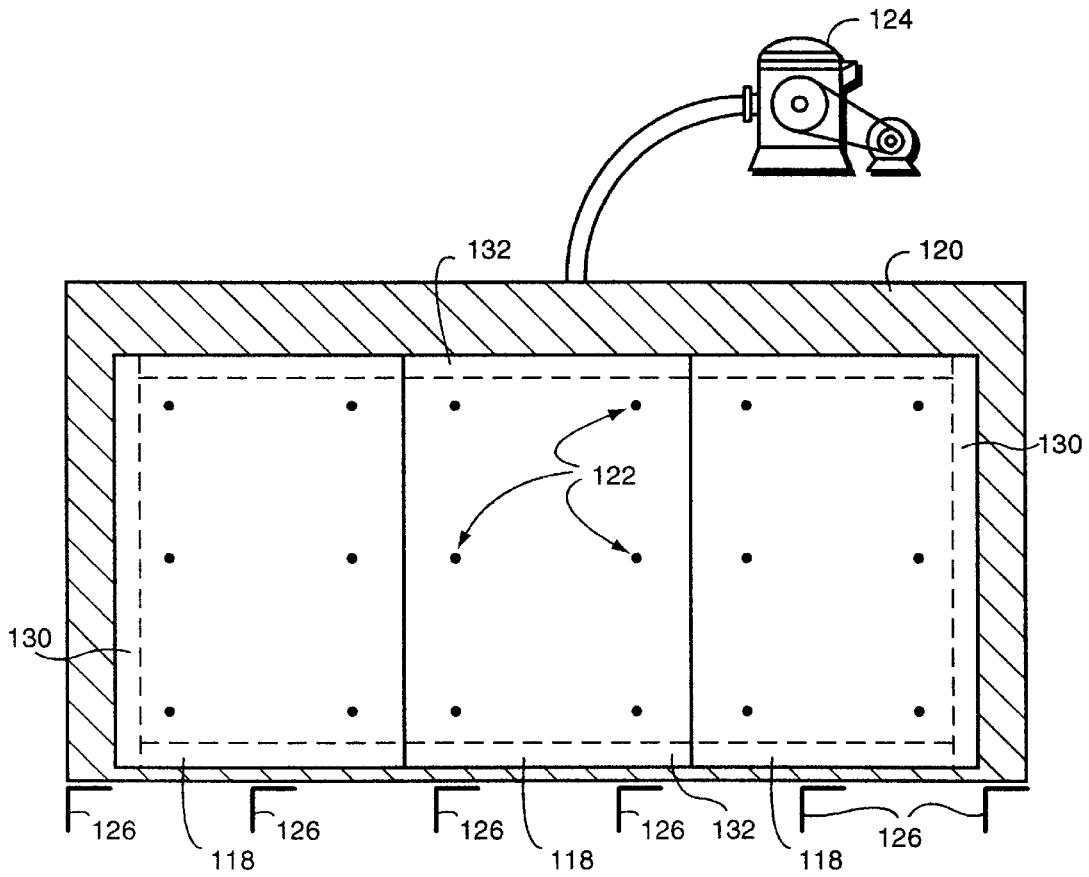
FIG. 8 is a schematic plan view of a vacuum table for retaining a panel during assembly.

Commercially available backer board is provided in sizes that may be smaller than an overall module panel size according to this invention. Accordingly, several sections of backer board may need to be joined together to cover the exterior of a single framework 82. FIG. 7 illustrates schematically a technique for maintaining each of the backer board sections in an appropriate alignment with the other sections while foam is applied. One or more spikes or screws 114 are driven through the backing surface 104 using pre-drilled holes or threaded inserts. The fasteners 114 are driven at least partially into the backer board 64. The fasteners are all applied when the backer board is oriented in a proper side-by-side relationship. Subsequently, the spacers 84 and framework 82 are applied over the secured backer board sections and the foam is then applied. Alternatively, backer board sections can be positioned side-by-side as shown in FIG. 8. The sections 118 lay on a supporting surface 120 than includes a series of holes 122 each interconnected with a vacuum source. Such as the pump 124. A base support is provided in the form of a series of angle irons 126 in this embodiment. The vacuum strength and the weight of the backer board sections 118 determine the number of holes 122 required to secure each of the sections in an appropriate side-by-side alignment. The framework is placed over the sections 118 laid on appropriate spacers 130 and 132 (shown in phantom). Note that spacers can be provided to the entire perimeter of the backing surface or can be provided adjacent only particular members such as the vertical members or horizontal members. As used herein, the term spacer shall refer to any structure placed on any horizontal or vertical member to space the overall framework at a predetermined distance from the backer board assembly.

Figure 9:
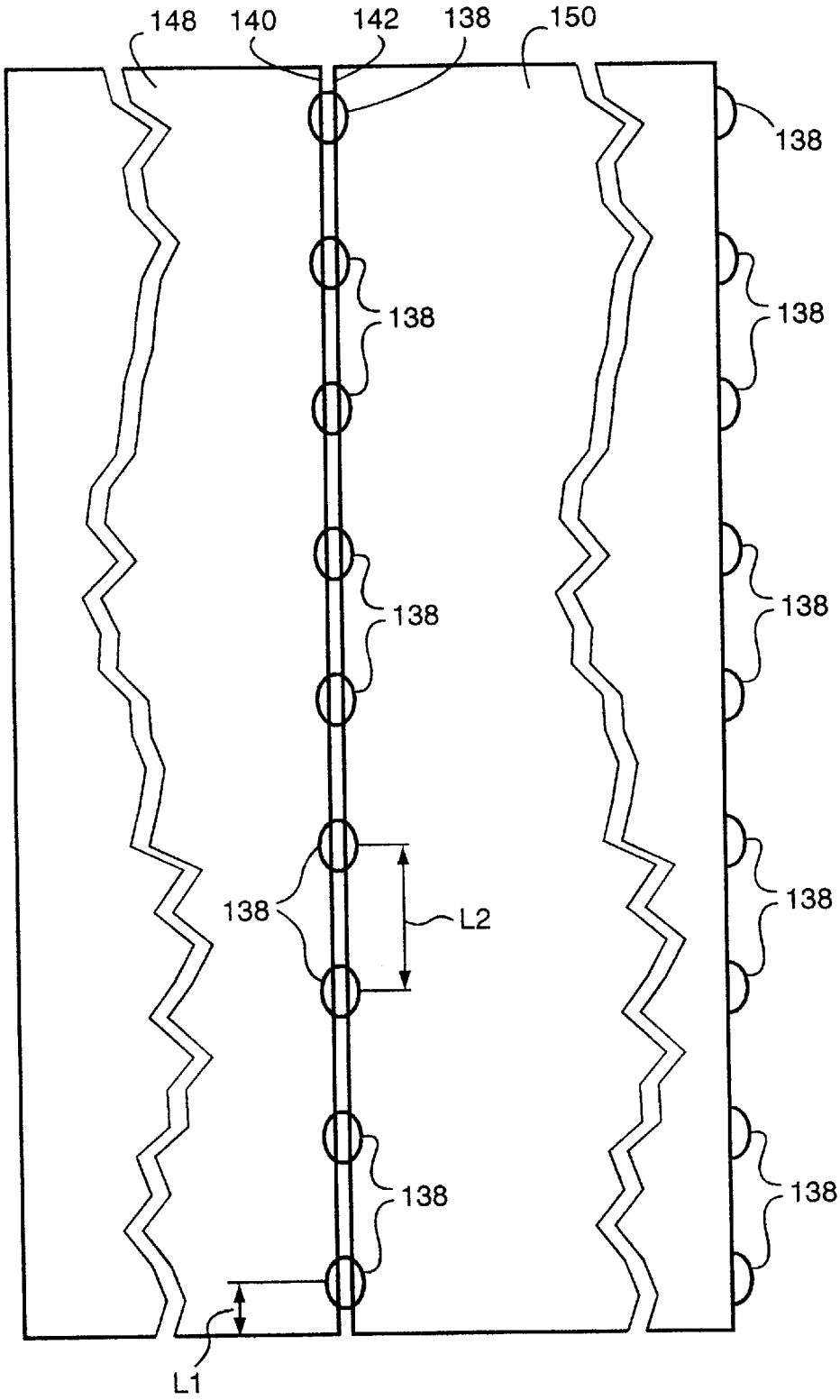
FIG. 9 is a partial schematic plan view of a joint formed between outer skin sections for use in a modular panel according to this invention.

Alignment of the backer board sections to form a continuous flat exterior surface is also desirable. Backer board having a ⅝ inch or larger thickness typically includes a tongue-and-groove arrangement for maintaining alignment along engaging edges. The alignment of backer board having a smaller thickness, such as ⅜ inch is more problematic. FIG. 9 illustrates a technique for aligning backer board involving the use of interlocking plates or biscuits 138 inserted into each of the confronting edges 140 and 142 of backer board sections 148 and 150, respectively. The biscuits 138 can comprise conventional wood biscuits, metal biscuits, fiberglass biscuits, plastic biscuits or any other acceptable material. The biscuits can include any surface finish such as a serrated finish. In assembly, the edges of each backer board section 148 and 150 are slotted along their length at appropriate locations to receive one-half of the biscuit. The blade in the biscuit or plate joiner can be specially adapted for cutting biscuits slots in cementacious backer board. For example, a diamond blade can be used. When all slots are provided in each of the confronting edges 140 and 142, the biscuits 138 are inserted therebetween and an appropriate adhesive can be applied between the edges and on the biscuits if desired. One form of adhesive is a polyurethane-based glue that is currently commercially available and that is typically used in conjunction with a water-wetted surface. Other appropriate adhesives, such as epoxy can be used to join panels. Alternatively, no adhesive may be used.

In this embodiment, the end biscuit is disposed at a distance L1 of approximately 4 inches and each biscuit therebetween is disposed at a distance L2 from an adjoining biscuit. These distances are taken from the center of each biscuit. The exact spacing of biscuits is highly variable. The above-described biscuit-joining method can be used in conjunction with other retention methods such as the spike detailed with reference to FIG. 7. Alternatively, splines or other joining devices can be provided to maintain confronting panel edges in alignment.

The foregoing has been a detailed description of a preferred embodiment of the invention. Various modifications and additions can be made without departing from the spirit or scope of this invention.

For example, vertical and horizontal members can be supplemented with or replaced with members disposed at angles at non-perpendicular angles to each other. As discussed above, the nature of the foam used to secure the backer board to the underlying framework can be varied. The characteristics of the foam can also be varied, particularly in view of specific building code requirements. It is contemplated also that various appliances can be used to enhance the alignment of backer board and frame members prior to application of form. Accordingly, this description is meant to be taken only by way of example and not to otherwise limit the scope of the invention.

What is claimed is:

1. A method for constructing a modular building panel comprising the steps of:

providing a backer board for applying an exterior finish thereto;

providing a structural metal framework having an outer perimeter and comprising a plurality of interconnected structural metal frame members wherein a plurality of interstitial bays are formed between said structural metal frame members;

suspending the structural metal framework apart from the backer board by over-hanging clamps at a predetermined gauged distance so that the backer board is fully isolated from the structural metal framework; and applying an insulating foam in liquid form over substantially an entire area defined between the backer board and the framework and within an area defined by the interstitial bays located between the structural metal frame members, which substantially fills the bays to adhesively join the backer board and the framework to each other when the foam layer subsequently cures into a solid form, whereby a desired spacing is maintained between the backer board and the framework and wherein the predetermined gauged spacing distance and an insulating property of the foam cause a dew-point condensation condition resulting from interior building temperature mixing with a cold outside air condition to occur remote from the frame members in a direction toward the backer board, wherein the backer board comprises a plurality of interconnected backer board sections adhered end to end, which form a backer board assemblage having a substantially flat exterior surface and having an outer perimeter, wherein the backer board sections are adhered end to end by an adhering structure, wherein the adhering structure comprises a plurality of biscuits, which maintain alignment between the confronting edges of the backer board sections, wherein the dimensions of the outer perimeter of the backer board assemblage substantially comport with the dimensions of the outer perimeter of the metal framework and wherein the backer board assemblage is assembled prior to applying the insulating foam; and providing a supporting structure for supporting the backer board assemblage, wherein the supporting structure is inclined at an angle A with respect to a ground surface such that the backer board is suspended at an incline.

2. The method as set forth in claim 1 wherein the backer board is secured to the inclined backing surface of the supporting structure by spike or screws.

3. The method as set forth in claim 1 wherein the backer board is secured to the inclined backing surface of the supporting structure by a vacuum.

4. A method for constructing a modular building panel comprising the steps of:

providing a backer board for applying an exterior finish thereto;

providing a structural metal framework having an outer perimeter and comprising a plurality of interconnected structural metal frame members wherein a plurality of interstitial bays are formed between said structural metal frame members;

suspending the structural metal framework apart from the backer board by over-hanging clamps at a predetermined gauged distance so that the backer board is fully isolated from the structural metal framework; and applying an insulating foam in liquid form over substantially an entire area defined between the backer board and the framework and within an area defined by the interstitial bays located between the structural metal frame members, which substantially fills the bays to adhesively join the backer board and the framework to each other when the foam layer subsequently cures into a solid form, whereby a desired spacing is maintained between the backer board and the framework and wherein the predetermined gauged spacing distance and an insulating property of the foam cause a dew-point condensation condition resulting from interior building temperature mixing with a cold outside air condition to occur remote from the frame members in a direction toward the backer board, wherein the backer board comprises a plurality of interconnected backer board sections adhered end to end, which form a backer board assemblage having a substantially flat exterior surface and having an outer perimeter, wherein the backer board sections are adhered end to end by an adhering structure, wherein the adhering structure comprises a plurality of biscuits, which maintain alignment between the confronting edges of the backer board sections, wherein the dimensions of the outer perimeter of the backer board assemblage substantially comport with the dimensions of the outer perimeter of the metal framework, wherein the backer board assemblage is assembled prior to applying the insulating foam and wherein the supporting structure further comprises a bottom stop and a backing surface.

5. The method as set forth in claim 4 wherein, in lieu of suspending the framework by overhanging clamps, the framework is positioned relative to the inclined backer board, prior to applying the insulating foam liquid, by temporarily adhering a plurality of insulating spacers to the inclined backer board and adhering the framework to the plurality of insulating spacers.

* * * * *